United States Patent [19]

Millett

[11] Patent Number: 5,063,677

[45] Date of Patent: Nov. 12, 1991

[54] GUN SIGHT ADJUSTABLE FOR WINDAGE AND DISTANCE

[76] Inventor: Ray C. Millett, 7275 Murdy Cir., Huntington Beach, Calif. 92647

[21] Appl. No.: 461,259

[22] Filed: Jan. 5, 1990

[51] Int. Cl.[5] ..... F41G 1/28

[52] U.S. Cl. ..... 33/252; 33/254; 33/257; 33/260

[58] Field of Search ..... 33/252, 253, 254, 257, 33/259, 260, 248

[56] References Cited

U.S. PATENT DOCUMENTS

| | | | |
|---|---|---|---|
| 1,147,469 | 7/1915 | Webb | 33/259 |
| 1,160,374 | 11/1915 | Buchanan | 33/259 |
| 1,618,749 | 2/1927 | Blizard | 33/259 |
| 2,006,262 | 6/1935 | Charvet | 33/252 |
| 2,014,735 | 9/1935 | Humeston | 33/257 |
| 2,083,677 | 6/1937 | Wilcox | 33/259 |
| 2,475,570 | 7/1949 | Neumann | 33/260 |
| 3,161,960 | 12/1964 | Badali | 33/257 |
| 3,495,339 | 2/1970 | Elliason | 33/257 |
| 3,942,256 | 3/1976 | Khaiduror et al. | 33/257 |
| 4,628,611 | 12/1986 | Ruffino | 33/254 |

*Primary Examiner*—William A. Cuchlinski, Jr.
*Assistant Examiner*—Alvin Wirthlin
*Attorney, Agent, or Firm*—Bernard L. Kleinke; William Patrick Waters; Jerry R. Potts

[57] ABSTRACT

An adjustable rear gun sight includes a rear sight fixed base for rigid attachment to a gun, and an elongated rear sight movable base disposed in longitudinal alignment with the fixed base. The movable base has a rearwardly disposed sight blade for helping to sight the weapon. A cam device, having a manually rotatable member, is mounted on the fixed base for retaining releasably the bases in a given longitudinal alignment relative to one another. The fixed base is journalled for enabling the manually rotatable member to rotate about a fixed axis of rotation. The cam device has an eccentrically located member which engages the movable base to drive the movable base in a reciprocative path of travel relative to a fixed axis of rotation so that the bases can be moved relative to one another into an adjusted position, and maintained releasably thereat.

10 Claims, 4 Drawing Sheets

11
12
35
37
30
40
5
20
48
51
79
73
53
41
C

Fig. 15
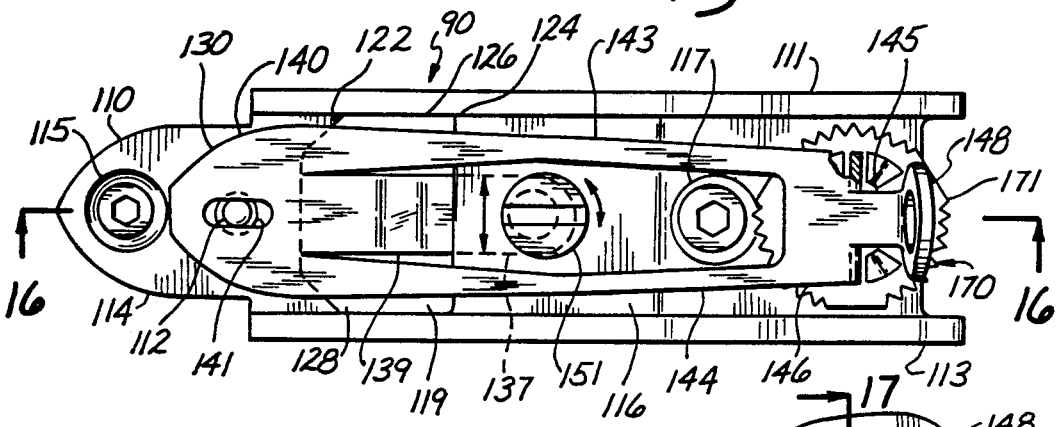
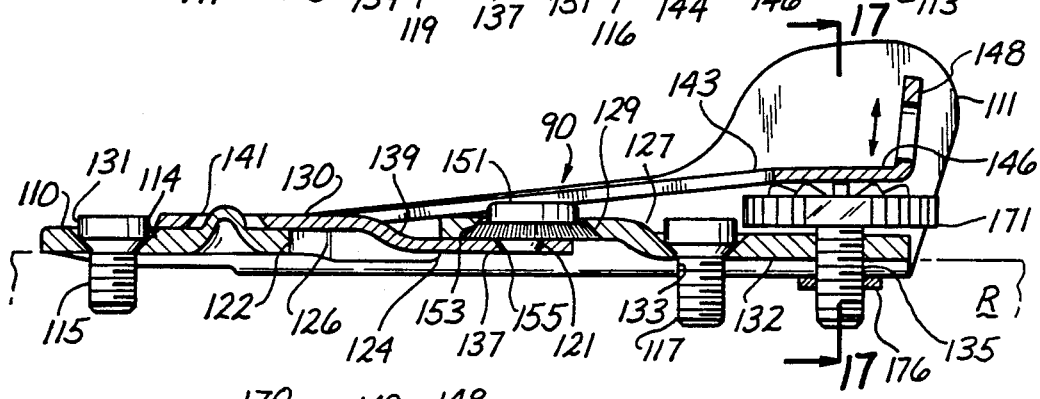
Fig. 16
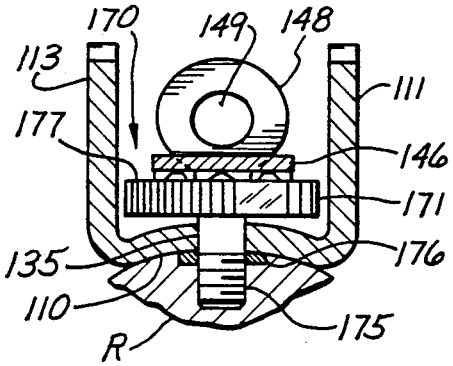
Fig. 17
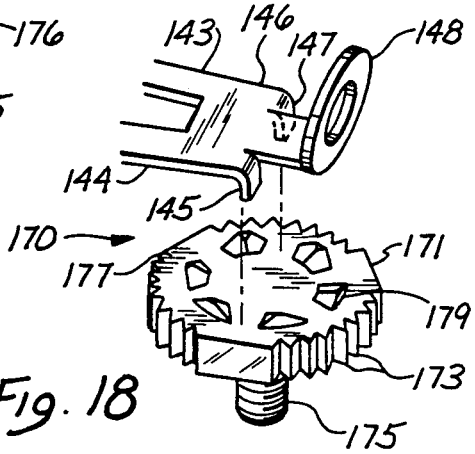
Fig. 18

GUN SIGHT ADJUSTABLE FOR WINDAGE AND DISTANCE

TECHNICAL FIELD

The present invention relates to gun sights and, more particularly, to adjustable rear sights for firearms such as rifles, and the method of using such sights.

BACKGROUND ART

Guns, including rifles, shotguns and pistols, often have a pair of sights, with one located near the front, and the other disposed toward the rear thereof. Sometimes, the front sight is a fixed member, and the rear sight is a blade, which may be raised or lowered adjustably, to conform to a desired line of sight relationship of the sights and target to the gun barrel The rear sight blade may be notched, or contain an aperture, to enable the user to align the rear sight with the front sight, along the barrel of the firearm.

Adjustability of the rear sight is often desirable, in order to permit the user to compensate for undesirable characteristics in the ballistic flight of the projectile. Such undesirable characteristics frequently result from manufacturing variations, or even defects. Moreover, improper or imprecise handling of the firearm can cause misalignment among the front and rear sights and the gun barrel.

It is recognized that, because there is often a great distance between the gun and the target, even minor variations in the position of the gun sight can have significant effects on the course of the bullet. As a result, adjustability of the rear sight is highly desirable to permit precise aiming alignment of the firearm at the target, and predictability in use thereof. Frequently, conventional firearms, such as rifles, are equipped with rear sights, which are manually adjustable for elevation. Such sights are oftentimes fixed in a trapezoidally shaped dovetail receptacle which is disposed transversely across the receiver of the firearm, near the stock. While such rear sights may be suitable for some applications, it is not uncommon for the shooter to replace the manufacturer-supplied rear sight with another, more precisely adjustable sight, in order to achieve greater accuracy in shooting.

In addition to precision of adjustment, the location and size of adjustable rear sights are very important considerations. In general, conventional rear sight adjustment mechanisms are located on the top of the gun barrel. As a result, such mechanisms must be compact in size and have a low silhouette design so as to permit a clear, unobstructed line of sight between the rear sight and the front sight Because of these factors, firearm rear sight adjustment mechanisms are generally intricate, complicated and expensive to manufacture. In addition, because of their complexity, they are all too frequently jarred out of proper adjustment. Moreover, the presence of moisture or grit during use in actual field conditions, can cause the sight adjustment mechanism to malfunction, or at least not function satisfactorily. This is especially the case if the mechanism is comprised of a number of small parts, all of which must cooperate precisely with each other in order for the sight to perform its alignment function in the desired manner. Therefore, it would be highly desirable to have a rear sight adjustment mechanism which would be relatively uncomplicated in design, capable of precise adjustment, and yet sufficiently durable to perform reliably under field conditions. At the same time, such a precisely adjustable gun sight should have a low silhouette, and should be relatively easy to adjust manually in field conditions.

Another important consideration in rear sight adjustment mechanism design relates to the effects of rough handling of the gun in the field. Because of such handling, adjustment mechanisms must be securely mounted to the firearm so as not to become dislodged or inadvertently jarred out of proper adjustment during use. Frequently, after a gun is purchased, the user elects to replace the manufacturer-supplied sight with a more desirable sight. In such cases, gunsmithing may be employed by the user to mount a sight adjustment mechanism irremovably on the firearm. Such gunsmithing can be an expensive technique, and it entails irreversible changes, such as tapping and threading screw holes, to the firearm. Owners of expensive firearms are frequently reluctant to have an expensive firearm permanently modified to accept a particular sight adjustment mechanism.

In addition to the need for rear sight elevational gun sights, the capability of lateral windage adjustment mechanisms in firearms is frequently desirable. Windage adjustments are useful in correcting for lateral deviations in the path of travel of the projectile. As in the case of elevational gun sight adjustment mechanisms, windage adjustment mechanisms have similar requirements for precision, reliability and predictability. For these reasons, windage sights are also complicated, expensive, sensitive, and easily damaged under field conditions. As a result, such sights are often unreliable under field use conditions. Because of such unreliability, many firearm manufacturers do not provide windage adjustments, and merely preset the rear sight for windage at the time of assembly of the firearm.

In some cases, conventional windage adjustments are sometimes so primitive and awkward as to comprise merely a sight, which is moved laterally for windage adjustment purposes, in a transverse dovetail slot, by means of a hammer and punch. Such an arrangement is clearly not precisely and accurately adjustable. Also, the adjustment cannot be made in a convenient manner. In view of the need for precise windage adjustment of firearms, it would be highly advantageous to have a rear gun sight which would have a windage adjustment capability, and which would be reliable, inexpensive to manufacture and capable of convenient, and yet sensitive windage adjustment under field conditions. Such a gun sight should be readily and conveniently adjustable for windage compensation purposes.

With further regard to field use, it is sometimes necessary for elevational and windage adjustments to be made in cold or wet weather conditions. In such conditions, it is desirable for the user to perform the adjustment while wearing gloves. It would be highly desirable to have such a gun sight which has the above mentioned characteristics, and which permits reliable and precise adjustment under adverse weather and lighting conditions.

Gun sights are known which are capable of both vertical and lateral adjustment for elevation and windage corrections. In this regard, reference may be made to U.S. Pat. No. 3,792,534 which discloses a gun sight in which axial adjustable movement is accomplished awkwardly, by loosening one screw, while tightening another one.

U.S. Pat. No. 4,628,611 discloses a gun sighting blade which is slidably mounted transversely relative to a sight body to provide windage adjustment capabilities by means of a sight adjustment screw. U.S. Pat. No. 4,575,961 discloses a gunsight elevating apparatus having a movable sight body, driven adjustably by a sight elevation adjusting screw which cooperates with the gun to move the sight body positionally adjustably relative thereto. However, the mechanisms disclosed in U.S. Pat. Nos. 4,628,611 and 4,575,961, require gunsmithing to mount the sight on the firearm.

The mechanisms disclosed in the foregoing patents, while providing elevation and windage adjustment capabilities, do not function entirely satisfactorily and reliably under adverse weather conditions during outdoor use. For example, the lock screw of U.S. Pat. No. 4,628,611 is very small and requires a screw driver or other blade type instrument for adjustment. In this regard, it would be very desirable to have an adjustable gun sight, which would function reliably and predictably under adverse outdoor field conditions, and which could permit precise rear sight manual adjustments, without requiring the use of a specialized tool.

DISCLOSURE OF INVENTION

Therefore, it is the principal object of this invention to provide a new and improved rear gun sight capable of convenient manual adjustment functions in a precise and controlled manner, without the need for special tools or instruments.

It is a still further object of the present invention to provide such a new and improved adjustable gun sight, which is capable of precise and sensitive control, even in severe outdoor weather conditions, and which is relatively uncomplicated in design and function.

Briefly, the above and further objects of the present invention are realized by providing an adjustable rear gun sight, which may be adjusted positionally relative to a fixed front sight in a convenient manual manner. The inventive sight is adjustable for both elevation and windage, and is uncomplicated in design and function.

An adjustable gun sight includes a rear sight fixed base for rigid attachment to the gun, and an elongated rear sight movable base disposed in longitudinal alignment with the fixed base. The movable base has a rearwardly disposed sight blade for helping to sight the gun. A cam device, having a manually rotatable member, is mounted on the fixed base for retaining releasably the bases in a given longitudinal alignment relative to one another. The fixed base is journalled for enabling the manually rotatable member to rotate about a fixed axis of rotation. The cam device has an eccentrically located member which engages the movable base to drive the movable base in a reciprocative path of travel relative to a fixed axis of rotation so that the bases can be moved relative to one another into an adjusted position, and maintained releasably in the adjusted position.

A notched, tapered slider is disposed slidably within an axial slot in the movable base, for raising and lowering the sight blade for elevational adjustment. Thus, the inventive can be adjusted positionally, both laterally and vertically, for windage and elevational corrections.

It will be recognized that the present invention affords several distinct advantages over conventional gun sights. The sight can be adjusted manually and precisely in a convenient manner, even in adverse weather conditions. Both elevation and windage adjustments can be accomplished in an uncomplicated mechanism having few moving parts. Further, the moving parts are located within the gun sight so as to eliminate, or at least to reduce greatly the probability of loss of parts, even under rough handling conditions. Elevational and windage adjustments can be made independently of each other. Another significant advantage of the present invention is the fact that it fits securely within a dovetail receptacle, or slot, of conventional firearms, thereby eliminating the need for gunsmithing during installation.

BRIEF DESCRIPTION OF THE DRAWINGS

The above mentioned and other objects and features of this invention and the manner of attaining them will become apparent, and the invention itself will be best understood by reference to the following description of the embodiments of the invention in conjunction with the accompanying, drawings, wherein:

FIG. 15 is an enlarged top plan view of another adjustable rear gun sight, which is constructed in accordance with the present invention;

FIG. 16 is a side elevational view of the sight of FIG. 15, taken substantially on line 16—16;

FIG. 17 is an enlarged detail view of the right of FIG. 16, taken substantially on line 17—17 thereof; and FIG. 18 is a fragmentary, exploded, pictorial view of an elevator mechanism of the sight of FIG. 15.

BEST MODE FOR CARRYING OUT THE INVENTION

Figure 1:
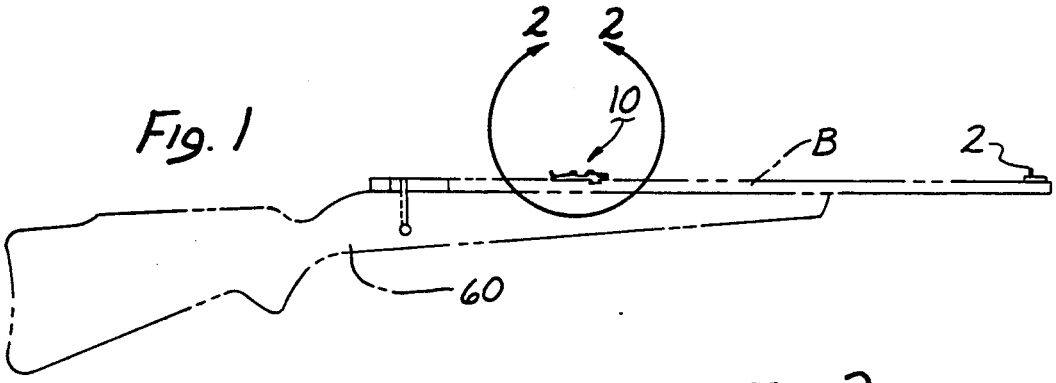
FIG. 1 is a side elevational view of an adjustable rear gun sight, which is constructed according to the present invention, and which is shown fixed to a conventional rifle illustrated in broken lines.

Referring now to the drawings, and more particularly to FIGS. 1-4 thereof, there is shown an adjustable rear gun sight 10 which is constructed in accordance with the present invention. The sight 10 is detachably mounted in a conventional dovetail receptacle, or slot, located on the top of a conventional rifle 60, and is adapted to be aligned with a conventional front sight 2 (FIG. 1), for aiming the rifle 60. The sight 10 is adapted to serve a pair of independent, dual functions, by enabling both an elevational adjustment and a windage adjustment.

While a rifle is shown and described herein, it is to be understood that the inventive sight may be employed on various different types and kinds of guns or firearms, such as pistols, and others.

Figure 2:
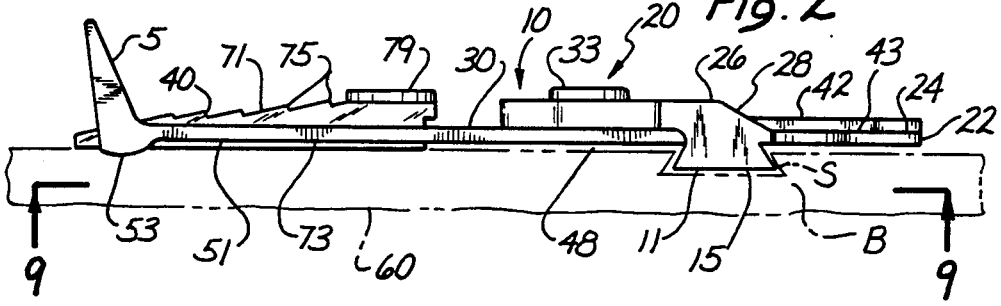
FIG. 2 is a greatly enlarged side elevational view of the gun sight of the encircled portion of FIG. 1.
Figure 3:
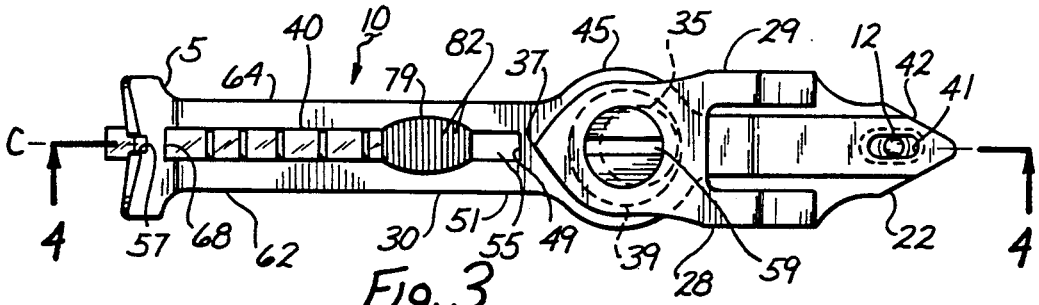
FIG. 3 is a top plan view of the gun sight of FIG. 1.

The sight 10 generally comprises a rear sight fixed base 11, which is rigidly and removably attached to a conventional, transversely disposed, trapezoidally shaped, dovetail receptacle, or slot, generally indicated at S in FIG. 2, in barrel B of the rifle 60. An elongated rear sight movable base 30, is connected adjustably movably in generally longitudinal alignment with the rear sight fixed base 11. An upturned sight blade 5 is integrally connected at the rear end of the base 30, to be used by the shooter to sight the rifle 60.

Elevational changes are made by moving manually adjustably the sight blade upwardly or downwardly relative to the top of the rifle barrel B. Windage adjustments are made by moving manually adjustably the sight blade transversely relative to the center line C (FIG. 3) of the rifle 60.

Figure 5:
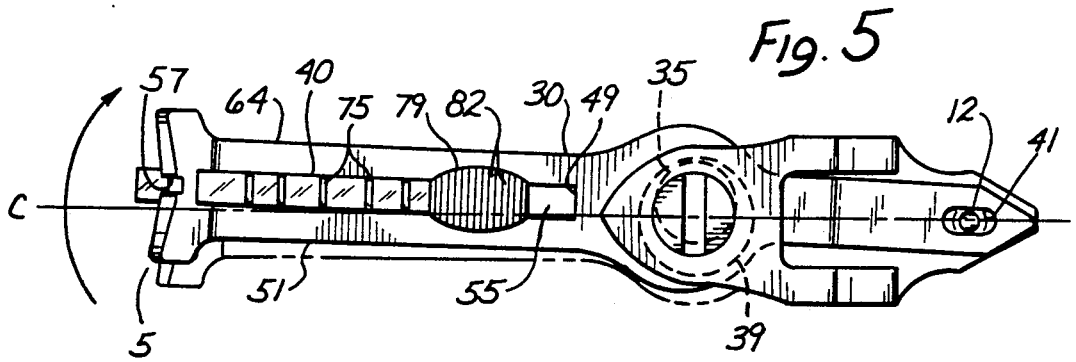
FIG. 5 is a top plan view of the gun sight of FIG. 1, illustrating it in a laterally adjusted position leftwardly for windage correction.
Figure 6:
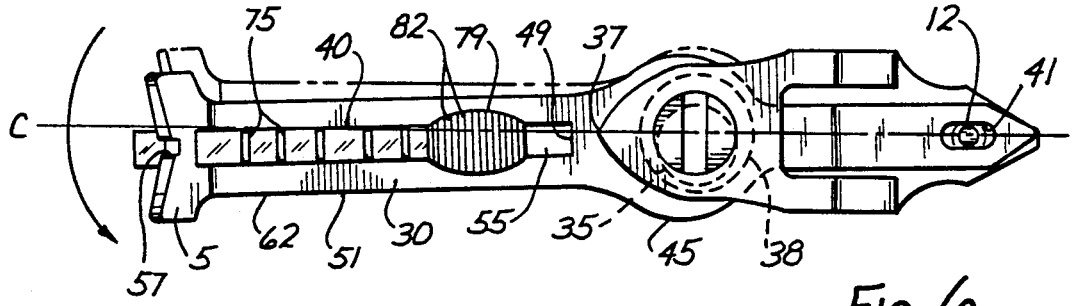
FIG. 6 is a top plan view, similar to FIG. 5, of the gun sight of FIG. 1, illustrating it in a laterally adjusted position rightwardly for windage correction.

For the purpose of facilitating the windage correction, a cam device, generally indicated at 20, is rotatably mounted between the fixed base 11 and the movable base 30, to cause the bases to move adjustably angularly relative to one another, as best seen in FIGS. 5 and 6, when the cam device is rotated about its axis. In order to provide elevational adjustments manually, a tapered slider 40 fits under the sight blade and is mounted slidably within the base 30, to be moved longitudinally manually for raising or lowering the blade 5 relative to the barrel.

Figure 4:
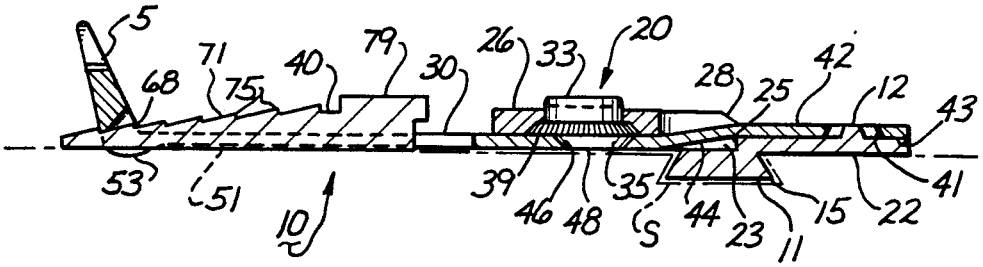
FIG. 4 is a sectional view of the gun sight of FIG. 3, taken on line 4—4 thereof.

Considering now the fixed base 11 in greater detail with reference to FIGS. 2–4, 7 and 8, the base 11 has a downwardly projecting dovetail fitting 15. As depicted in FIG. 4, the dovetail fitting 15 is trapezoidally shaped and is adapted for mounting securely the sight 10 within the conventional dovetail slot S (FIGS. 2 and 4).

To mount the rear sight 10 on the rifle 60, the user aligns the fitting 15 with the dovetail receptacle 13 and, utilizing a mallet or similar tool (not shown), moves the dovetail fitting 15 into a desired position on the top of the barrel. The sight 10 may be removed by reversing the installation process without any damage to, or modification of, the rifle 60.

Figure 7:
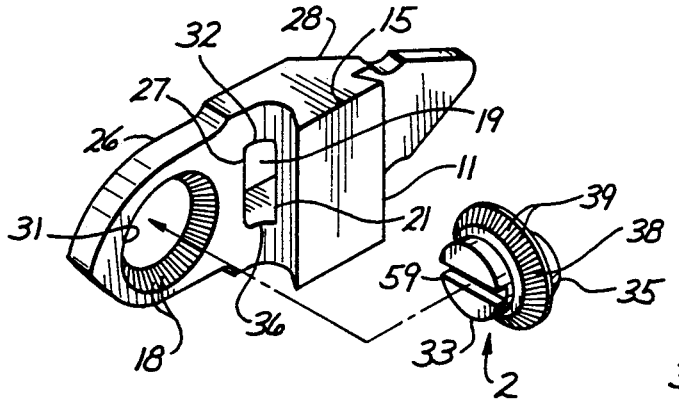
FIG. 7 is a pictorial view of the bottom and right side exploded view of a fixed base and a top and side pictorial view of a cam device of the sight of FIG. 1.
Figure 8:
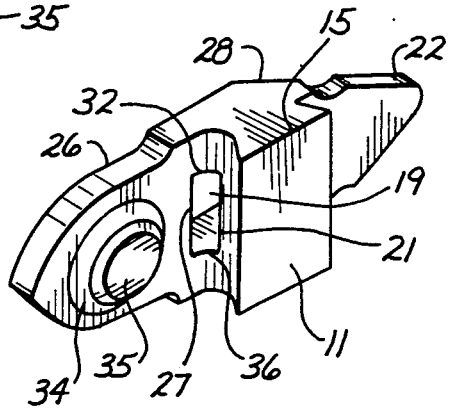
FIG. 8 is a pictorial view of the bottom and right side of the fixed base and the cam device of FIG. 7, showing the base and the cam device assembled.
Figures 9, 10, 11, 12, 13, 14:
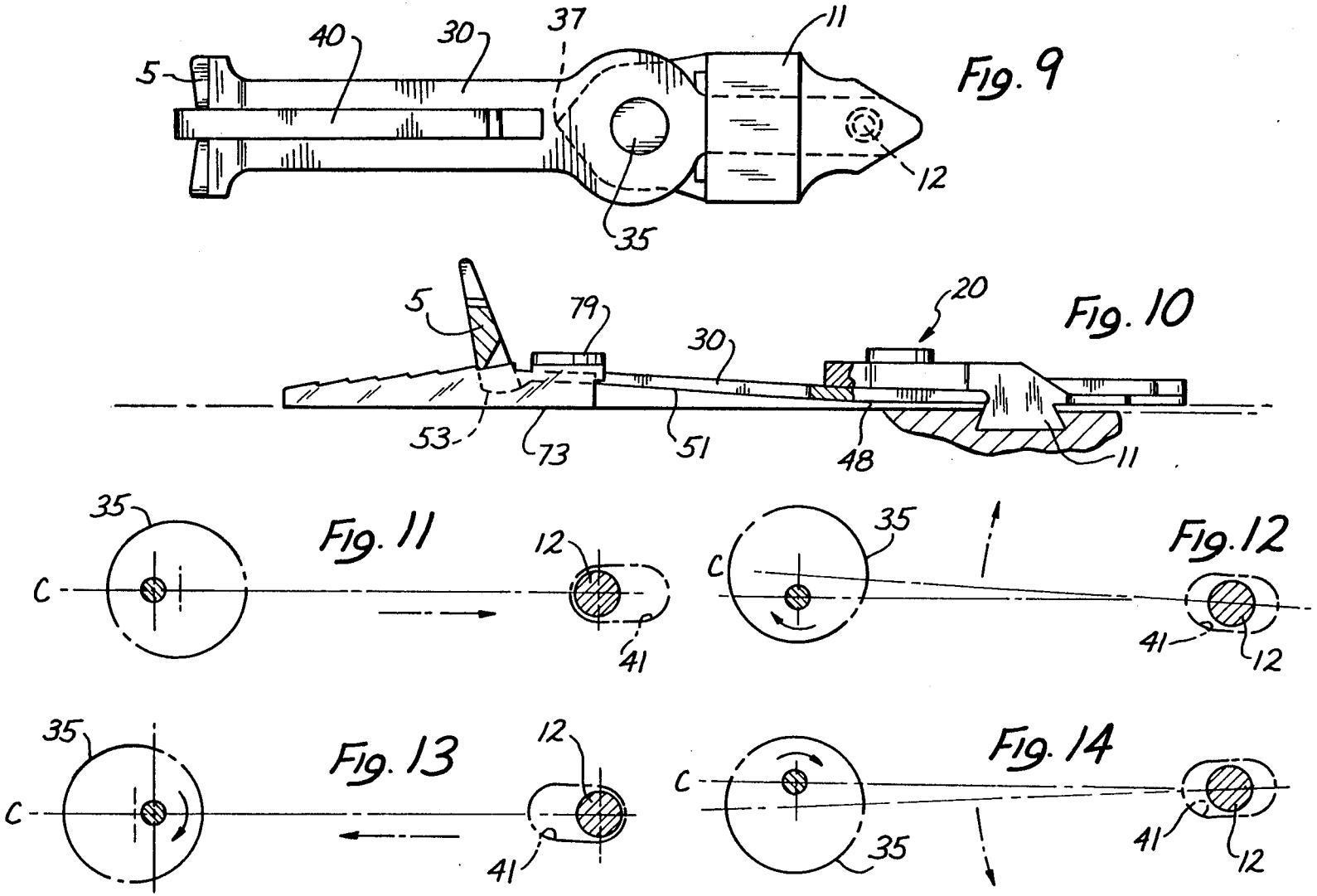
FIG. 9 is a bottom plan view of the sight of FIG. 2, taken on line 9—9 thereof.
FIG. 10 is a side, partially sectional view of the gun sight of FIG. 1.
FIGS. 11-14 schematically depict various lateral adjusted positions of the movable base in relation to the cam device.

Projecting forwardly from the upper, forward portion of the dovetail fitting 15 is a pointed front end or platform 22. The platform 22 is flat and spade-like in shape, having a generally smooth upper surface 24 for supporting the movable base 30. A locator pivot pin 12 projects upwardly from the upper surface 24 for engaging the movable base 30, for reciprocative movement relative thereto. A pair of shoulders, 28 and 29, extending backwardly and upwardly from the upper surface 24, are integrally connected to a generally flat second platform 26. A rear edge 25 of the first platform 22, the inner surfaces of the shoulders 28 and 29, and a forward edge 27 of the second platform 26 define a recess 23, which, as depicted in FIG. 4, is located above the dovetail fitting 15. An upper rear edge 21 of the dovetail fitting 15, the forward edge 27 and the edges 32 and 36 form an aperture 19 (FIGS. 7 and 8).

During assembly of the sight 10, a blade 42 of the movable base 30 is inserted through the aperture 19 and is held therein for reciprocative movement. In this regard, the recess 23 permits sufficient clearance so that the blade 42 can be securely and movably retained within the fixed base 11.

A chamfered opening 31 is located in the center of the second platform 26 for receiving the cam device 20 and for journalling it for rotation about a fixed axis. The opening 31 has a diameter, as measured at the top surface of the second platform 26, which is smaller than its diameter as measured at the bottom surface of the second platform 26 (FIG. 7). The wall of the opening 31 includes a plurality of teeth 18, to engage the cam device 20 movably adjustably.

Considering now the cam device 20 in greater detail with reference to FIGS. 1–8, the cam device 20 has a knob 33 which has an outside diameter slightly less than the smaller diameter of the chamfered opening 31. In operation, the knob 33 is rotated manually about the fixed axis of rotation, in the opening 31, to move the movable base 30 for windage adjustment. Projecting downwardly and outwardly from the knob 33 is a conical skirt 38 which has a plurality of teeth 39 for engagement with the teeth 18 to hold the cam device 20 in a fixed position. The skirt 38 has a flat bottom surface 34 which is adapted for movement against the upper surface of the movable base 30. An eccentrically located, truncated cone 35 projects downwardly from the surface 34 to engage a chamfered receiving means 46 in the movable base 30 (FIG. 4). Rotation of the knob 33, about its fixed axis of rotation, results in orbital rotation of the cone 35 which, in turn, imparts movement to the base 30 to enable the user to make precise, controlled windage adjustments to the sight 10.

The knob 33 has a slot 59 in its upper surface to enable the user to utilize a coin or blade-like tool for rotating the cam member 20. It will be recognized that the cam member 20 could be rotated without the use of a tool and, further, the knob 33 could have a seared or knurled edge to facilitate ease of manual rotation.

Considering now the movable base 30 in greater detail with reference to FIGS. 2–6, 9 and 10, the base 30 has a forwardly disposed blade 42 having a smooth bottom surface 43 for movement with relation to the fixed base 11. An elongated slot 41, having its longer dimension in the longitudinal plane of the rear sight 10, located in the forward portion of the blade 42, receives the pivot pin 12, for movement thereabout. An intermediate portion 44, integrally connected to the blade 42, is angulated downwardly with regard to the blade 42 to pass over the recess 23 and through the aperture 19 of the fixed base 11 so as to be securely, and movably held within the fixed base. Behind the intermediate portion 44, and integrally connected therewith, is an enlarged rounded portion 45 having a chamfered opening 46 for receiving the cone 35 for rotation of the cone therewithin. A spring portion 51, integrally connected to the enlarged rounded portion 45, holds the enlarged rounded portion 45 away from the surface of the rifle 60, thereby forming a space 48 therebetween. The enlarged rounded portion 45 ends in a rear edge 49 which is disposed between a right leg 62 and a left leg 64, each of which extends rearwardly from the portion 45, and is integrally connected therewith. The legs 62 and 64 are integrally connected to the sight blade 5 at the rear of the sight 10. The rear edge 49, the left and right legs, 62 and 64 respectively, and the sight blade 5 define an elongated axial slot 55 to hold slidably therein the tapered slider 40.

Considering now the rear sight blade 5 in greater detail with reference to FIGS. 2–6, the blade has a centrally located notch 57 along its upper edge, for allowing the shooter to sight through the notch while aiming the firearm. It will become apparent to those skilled in the art that other different types and kinds of sight blades may be employed. For example, peep sights, and other conventional sights having different configurations, will function satisfactorily. The rear sight blade terminates, at its lower end, in a boss 53. When the sight blade 5 is at its lowermost position, the boss 53 rests against the barrel of the rifle 60 and, in cooperation with the spring portion 51, the boss 53 defines the space 48. A cutout 68 is centrally located along the bottom of the sight blade 5 to permit movement of the tapered slider 40 therethrough.

Considering now the tapered slider 40 in greater detail with reference to FIGS. 2–6, the slider 40 is an elongated member disposed for movement within the axial slot 55 for elevating the sight blade 5. In operation, the user places a thumb or finger on a forwardly located pad 79 to adjust the elevation of the blade 5 by moving the slider 40 to a desired location. The pad 79 is scored by scoring lines 82 to enable non-slip contact between the user and the slider 40. The slider 40 has a smooth bottom surface 73 for sliding longitudinally along the barrel of the rifle 60. A top surface 71 inclines upwardly and forwardly from the rear sight blade 5. For elevation of the rear sight blade, the user engages the pad 79 and moves the slider 40 in the axial slot 55. The rear portions of the slider 40 extend through the cutout 68 of the sight blade 5. The top surface 71 of the slider 40 has a plurality of upwardly projecting notches, such as the notch 75 of FIGS. 3, 5 and 6. During use, the slider 40 is moved toward or away from the blade 5 until the desired elevation of the blade is attained and one of the notches 75 engages the back of the rear sight blade 5 thereby holding it in a desired, spaced apart relationship with the gun barrel of the rifle 60.

Considering now the windage adjustment features of the present invention in greater detail with reference to FIGS. 5, 6 and 11–14, windage adjustment is accomplished by moving the sight blade 5 transversely in relation to the centerline C of the rear sight 10. While the rifle is in use, and windage adjustments are not being made, the spring portion 51 of the movable base 30 urges the skirt 39 into the chamfered opening 31, enabling the teeth 39 to engage the teeth 18, to hold the cam device 20 in a fixed condition.

In order to make the windage adjustment, the user depresses the knob 33, thereby separating the teeth 39 from the teeth 18, to permit rotation of the knob and of the skirt 39 about a fixed axis of rotation. The cone 35, on the other hand, because of its eccentric location on the bottom surface 34, moves in an orbital path in relation to the axis. The disposition of the cone 39 in the receiving means 46, results in reciprocative movement of the movable base 30 with respect to the fixed base 11. In this manner, the sight blade 5 is moved transversely with respect to the centerline of the rear sight 10, to fix the blade reversibly in a desired position. It will be noted, by reference to FIG. 2, that when the center of the sight blade 5 is located directly in line with the centerline of the rear sight 10, a pointer 37 points to the centerline bisecting the axial slot 55. In this condition, the cone 35, depicted in phantom in FIG. 2, has its diameter in the centerline of the rear sight 10 and the pivot pin 12 is disposed in the center of the slot 41. FIGS. 11–14 schematically illustrate the relationships among the cone 35, the pivot pin 12 and the slot 41, in relation to the centerline C, during orbital revolution of the cone 35.

After making the windage adjustment, the shooter releases the downward pressure on the knob 33, thus allowing the skirt 38 to be moved by the spring portion 51 into the opening 31. At this point, the teeth 39 engage again the teeth 18 thereby holding the movable base 30 and the cam device 20 in a fixed relationship. It will be recognized that the windage adjustment process, as herein described, can be performed, repetitively and reversibly, during use of the firearm, in response to changing windage conditions.

Considering now another form of the present invention with reference to FIGS. 15–18, an adjustable rear sight mechanism 90 has a rear sight fixed base 110, a cam device 120, a rear sight movable base 130, a rear sight 148, and a rear sight elevator, indicated generally as 170. The fixed base 110 has a pair of apertures 131 and 133 which are disposed axially in the centerline of the fixed base 110. Fastening devices, such as bolts 115 and 117 extend through the apertures 131 and 133, respectively, to mount the fixed base 110 fixedly to the receiver R of a firearm. A cam device 120, which is similar in structure and function to the cam device 20 of the previously described embodiment, is mounted on the fixed base 110. Rotation of the cam device 120 results in controlled, reversible, transverse movement of the movable base 130, to permit windage adjustment by movement of the rear sight 148. Elevational adjustments are made by utilization of the rear sight elevator 170 which, in operation, raises or lowers the rear sight 148 to a desired height.

Considering now the fixed base 110 in greater detail with reference to FIGS. 15 and 16, the fixed base 110 is shaped to conform to the barrel of a conventional rifle (FIG. 17). It is fixed to the receiver R of a rifle by conventional mounting means such as the bolts 115 and 117. As depicted in FIG. 17, the base 110 is arcuately shaped, in its transverse dimension, to fit over the barrel of a firearm.

The fixed base 110 has a forward portion 114 which is integrally connected on the right side to a right wall 111 and, on the left side, to a left wall 113. The left and right walls extend upwardly and backwardly, so that at the rearward portion of the fixed base 110, the left wall 111 and the right wall 113 frame the rear sight 148. The forward portion 114 has an upwardly projecting, centrally located pivot pin 112 for holding the movable base 130 for reciprocating movement thereabout.

Rearward of the pivot pin 112, a portion of the fixed base 110 is cut away to form a cutout 119. The cutout 119 is interposed between the front portion 114 and an intermediate portion 116 of the fixed base 110. The cutout portion is defined, at its forward edge, by a rear edge 122 of the front portion 114 and, at its rear edge, by a forward edge 124 of the intermediate portion 116. Portions 126 and 128 of the right wall 111 and the left wall 113 form, respectively, the left and right sides of the cutout 119. The intermediate portion 116 contains a chamfered opening 129 for receiving the cam device 120. Behind the chamfered opening 129, the fixed base 110 has a downwardly angular portion 127 which joins a rear portion 132. An aperture 133 in the rear portion 132 accepts mounting means 117 for mounting the rear sight mechanism 90 to the receiver R of a firearm. Rearward of the aperture 133 is an axially located aperture 135 for receiving the rear sight elevator 170.

Considering now the rear sight movable base 130 in greater detail with reference to FIGS. 15–18, the movable base 130 has a forward portion 140 which slides in a reciprocative path against the upper surface of the fixed base 110. The pivot pin 112 projects through a centrally located, elongated slot 141 to permit movement of the movable base 130 thereabout. Rearward of the axial slot 141 the movable base 130 divides into a right longitudinal member 143, a left longitudinal member 44 and a centrally disposed tongue 139. The left and right longitudinal members 143 and 144 respectively, are integrally connected to a flat portion 146 for support of a rear sight 148. The tongue 139 has a chamfered opening 155 for receiving the cam device 120. The flat portion 146 has an integrally connected blade 145 which, in turn, is integrally connected to the rear sight 148. On either side of the blade 145, the right and left longitudinal members bend downwardly to form fingers 147 and 145, respectively, to engage the rear sight elevator 170.

Considering now cam device 120 in greater detail, with reference to FIGS. 15 and 16, the cam device 120 is similar in structure and function to the cam device 20 of the sight 10. The device 120 has a knob 151 from which extends a skirt 153. Fixed to the bottom surface of the skirt 153 is an eccentrically located, truncated cone 155. The knob 151 and the skirt 153 are held movably in the aperture 153 in the chamfered opening 129. The chamfered opening 129 and the skirt 153 have teeth which are similar in structure and function to the teeth 18 and 39. The truncated cone 155 engages the chamfered opening 121 of the movable base 130 The intermediate portion 116 serves as a spring to hold the cam device 120 in the chamfered opening 124.

In operation, depression and rotation of the knob 151 permits rotation of the cam device 120 which results in reciprocative movement of the movable base 130 in relation to the fixed base 110. This results in movement, in a desired direction and amount, of the rear sight 148, transversely across the centerline of the rear sight mechanism 90.

Considering now the elevator 170 in greater detail with reference to FIGS. 15–18, the elevator 170 has a thumb wheel 171 having a threaded stem 175 projecting therefrom. The stem 175 is threadably engaged into a nut 176 embedded in a recess 178 in the receiver R of the firearm. Manual rotation of the thumb wheel 171 results in a raising or lowering of the rear sight 148 as depicted by the arrows in FIG. 16. A plurality of detents 179 are located on an upper surface 177 of the thumb wheel 171. Each of the detents 179 is comprised of a first shoulder 191 and a second shoulder 195 which join at a seam 197 to define a flat portion 196.

In operation, elevational adjustments to the rear sight 148 are made by rotation, in a desired direction, of the thumb wheel 171, as indicated by the arrow of FIG. 16. Serrations, such as the serration 173 on the edge of the thumb wheel 171, permit firm contact between the thumb of a user and the thumb wheel 171 for rotation thereof. As the thumb wheel 171 rotates, the detents 179 engage the downwardly projecting fingers 145 and 147. The shoulders 191 and 195, together with the flat portion 196 of the detents 179 provide for a smooth raising and lowering of the rear sight 148. In use, the rear sight 148 is raised or lowered to a desired height, by rotation of the thumb wheel 171. After a desired height is attained, the fingers 145 and 147 rest against the upper surface 177 of the thumb wheel 171 between the detents 179.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. An adjustable rear sight for a gun comprising:

a rear sight fixed base for rigid attachment to the gun;

an elongated rear sight movable base disposed in longitudinal alignment with said fixed base, said movable base having a sight blade for helping to sight the gun;

a cam device having a manually rotatable member mounted on said fixed base for retaining releasably the bases in a given longitudinal alignment relative to one another;

means on said fixed base for journalling for rotation about a fixed axis of rotation said manually rotatable member, said means including an opening for receiving said cam device and including fixed teeth projecting into said opening;

said cam device having a skirt member including a plurality of skirt teeth for engaging said fixed teeth, said cam device further having a cam member for driving said movable base relative to said fixed base in response to the axial rotation of said manually rotatable member;

cam following means on said movable base for receiving said cam member to enable it to drive the movable base in a reciprocative path of travel relative to said fixed axis of rotation so that said bases can be moved relative to one another into an adjusted position and to retain them releasably thereat;

said skirt member having a central axis disposed in a spaced apart relationship relative to the axis of said cam member to cause said cam member to move in an eccentric path of travel relative to said fixed axis as said rotatable member rotates;

said movable base having a spring portion for urging resiliently said skirt teeth and said fixed teeth into releasable engagement for retaining the bases releasably in an adjusted position, and for permitting said cam device to be moved against the force of said spring portion to permit free axial relative rotation of said skirt teeth and said fixed teeth into an adjusted position so that said cam device can be released to permit said spring portion to urge said skirt teeth and said fixed teeth into engagement therebetween.

2. A rear sight of claim 1, including means for reversibly attaching said fixed base to a firearm.

3. A rear sight of claim 2, wherein said attaching means is a dovetail fitting.

4. A rear sight of claim 1, said fixed base including means for guiding said movable base for movement thereabout.

5. A rear sight of claim 4, wherein said guiding means includes an upwardly projecting pin for guiding said movable base for movement thereabout.

6. A rear sight of claim 1, having means defining a slot for slidably holding an elevator adjustment means.

7. A method of adjusting the rear sight of claim 1, comprising:

rotating manually said rotatable cam member about said fixed axis to move forcibly said movable base through a reciprocative path of travel; and terminating the manual rotation when the movable base is disposed at the adjusted position.

8. A rear sight of claim 1, further including elevator means for altering the height of said sight blade with respect to said gun, said elevator means including a rotatably mounted wheel having detent means for engaging said sight blade for height adjustment purposes.

9. A rear sight of claim 1, further including elevator means for altering the height of said sight blade with respect to said gun, said elevator means including movably mounted slider means having a plurality of notches thereon for engaging said sight blade for height adjustment purposes.

10. A rear sight of claim 1 wherein said opening is chamfered.

* * * * *